US009560906B2

(12) United States Patent
Dyer

(10) Patent No.: US 9,560,906 B2
(45) Date of Patent: Feb. 7, 2017

(54) NAIL FILE CASE WITH INTEGRATED FEATURES

(71) Applicant: SPILO WORLDWIDE, INC., Los Angeles, CA (US)

(72) Inventor: Ian Allen Dyer, Los Angeles, CA (US)

(73) Assignee: SPILO WORLDWIDE, INC., Los Angeles, CA (US)

( * ) Notice: Subject to any disclaimer, the term of this patent is extended or adjusted under 35 U.S.C. 154(b) by 262 days.

(21) Appl. No.: 14/279,274

(22) Filed: May 15, 2014

(65) Prior Publication Data

US 2015/0327652 A1 Nov. 19, 2015

(51) Int. Cl.

| | |
|---|---|
| ***A45D 29/20*** | (2006.01) |
| ***A45D 29/16*** | (2006.01) |
| ***A45D 29/17*** | (2006.01) |
| ***A45D 29/04*** | (2006.01) |

(52) U.S. Cl.

CPC ..... *A45D 29/20* (2013.01); *A45D 29/04* (2013.01); *A45D 29/16* (2013.01); *A45D 29/17* (2013.01)

(58) Field of Classification Search

CPC ..... A01K 13/00; A01L 11/00; A45C 5/005; A45D 29/04; A45D 29/06; A45D 29/12; A45D 29/16; A45D 29/17; A45D 29/18; A45D 29/20; A61B 17/54; B24B 55/05; B24D 15/02; B65D 43/16; B65D 43/162; B65D 43/22; B65D 5/4204

USPC ..... D28/59; 132/73.5, 75.6, 75, 76.2, 76.4, 132/76.5; 1/59

See application file for complete search history.

(56) References Cited

U.S. PATENT DOCUMENTS

| | | | | | |
|---|---|---|---|---|---|
| 1,367,975 | A * | 2/1921 | Ivory | A45D 29/04 | 132/75.6 |
| 1,773,770 | A * | 8/1930 | Adam | A45D 29/18 | 132/73 |
| 1,868,985 | A * | 7/1932 | Lyon | A45D 29/11 | 132/73.5 |
| 2,019,580 | A | 11/1935 | Poux | | |
| 2,247,567 | A * | 7/1941 | Wendell | 132/75.6 | |
| 3,215,150 | A * | 11/1965 | Guardino | 132/75.4 | |
| 3,339,562 | A * | 9/1967 | Rowe | 132/76.5 | |
| 3,754,556 | A * | 8/1973 | Watkins | 132/73.6 | |
| 4,559,957 | A | 12/1985 | Hokama | | |
| 5,090,427 | A | 2/1992 | Sherts | | |
| 5,349,969 | A | 9/1994 | Price | | |
| D447,285 | S | 8/2001 | Trybus | | |
| D453,991 | S | 3/2002 | Trybus | | |
| D501,714 | S | 2/2005 | Trybus | | |
| D597,255 | S * | 7/2009 | Wittke-Kothe | D28/59 | |
| 8,006,704 | B1 * | 8/2011 | Willix | 132/73.6 | |
| D655,864 | S * | 3/2012 | Zeitouny | D28/59 | |
| D682,538 | S | 5/2013 | Rollo | | |
| 2002/0148479 | A1 * | 10/2002 | Willis | 132/75.3 | |
| 2004/0194795 | A1 | 10/2004 | Cho | | |
| 2006/0191552 | A1 * | 8/2006 | Sherts | 132/75.6 | |

(Continued)

FOREIGN PATENT DOCUMENTS

DE 3321352 * 12/1983

*Primary Examiner* — Todd E Manahan
*Assistant Examiner* — Jennifer Gill
(74) *Attorney, Agent, or Firm* — Kleinberg & Lerner, LLP; Marshall A. Lerner; Marvin H. Kleinberg

(57) ABSTRACT

A fingernail file case includes a hole through which filing can take place while the case remains otherwise fully closed. The case may optionally include a projection adapted to scrape under a fingernail and/or a blade adapted to push a cuticle.

12 Claims, 7 Drawing Sheets

(56) References Cited

U.S. PATENT DOCUMENTS

| | | | | |
|---|---|---|---|---|
| 2011/0155796 | A1* | 6/2011 | Moore | 229/120.08 |
| 2011/0226270 | A1* | 9/2011 | Rivera | 132/73.6 |

* cited by examiner

NAIL FILE CASE WITH INTEGRATED FEATURES

BACKGROUND

The present invention relates to nail care systems and methods, and in particular, to a nail file case with integrated features.

Nail files are well known in the art. Nail files have traditionally been made from stainless steel, with serrations scored into the surface of the metal to provide a rough abrasive area for filing a nail. Often, steel nail files have included hard shaped ends for pushing back the cuticle and for cleaning out dirt under the nail. These all-in-one steel files however, suffer from the fact that they are relatively expensive, and while intended to be permanent, once they become blunt, they are no longer effective. Also, they can become dangerous, as they represent a fairly sharp object which is intended for carrying about the person.

More recently, disposable nail files have been made from plastic and/or foam cores which have an abrasive-coated surface attached to one or both sides of the core, making the file both abrasive and flexible. These files are sometimes sold inside a plastic container for protecting the file and for facilitating transport of the file inside make-up bags, travel kits, purses, or the like, without damaging adjacent items by abrasion. These files avoid many of the problems associated with steel nail files.

However, they do have problems of their own. One problem arising with plastic or foam core nail files is the fact that they do not lend themselves to having hard shaped ends formed onto them for pushing back the cuticle or for cleaning out dirt under the nail. Thus, users are typically obliged to possess additional tools to accomplish these tasks. This adds to the inconvenience of having a nail file, and also to the cost, because additional tools must be purchased to accomplish the same tasks as could be accomplished by the older stainless steel files.

There is a need in the art for a solution to this problem. The present invention addresses these and other needs.

SUMMARY OF THE INVENTION

The invention provides a nail file case preferably of the kind having a generally clam shell type configuration, with an upper lid and a lower base, the lid being connected to the base by a flexible hinge, with additional nail care features integrated therein. Such features may include a slot extending along an upper surface of the lid, the slot being sized to receive a finger nail tip therethrough, a cuticle pusher formed on the case, the cuticle pusher including a blade being configured for pushing a cuticle of a finger nail, and/or a nail cleaner formed on the case, the nail cleaner including a projection extending from the case being configured for insertion beneath a finger nail for scraping out dirt lodged thereunder.

In some embodiments, the slot extends longitudinally along the length of the lid terminating short of the ends of the lid, and is arranged along a center line of the lid. In some embodiments, the blade is formed at an elongate extremity of the lid, and is formed with a concave depression on an exterior surface of the lid which terminates in a thin outer edge adapted for pushing a cuticle. In some embodiments, the projection is formed at an elongate extremity of the base and extends horizontally therefrom, with a concavity formed in an upper surface thereof. In further embodiments, the blade extends over the projection when the case is closed.

In some embodiments, the slot is dimensioned to have a width extending between 0.2 inch and 0.4 inch, a length between 1.5 inch and 2.5 inch, and a depth extending between 0.05 inch and 0.1 inch. In preferred embodiments, the blade is dimensioned to have a length extending between 0.3 inch and 0.5 inch and an edge thickness extending between 0.02 inch and 0.06 inch. In some embodiments, the projection is dimensioned to have a length extending between 0.1 inch and 0.3 inch and a width between 0.3 inch and 0.6 inch.

These and other advantages and features of the invention will become apparent from the following detailed description, taken in conjunction with the accompanying drawings, which illustrate, by way of example, the features of the invention.

DETAILED DESCRIPTION OF THE PREFERRED EMBODIMENTS

Figure 1:
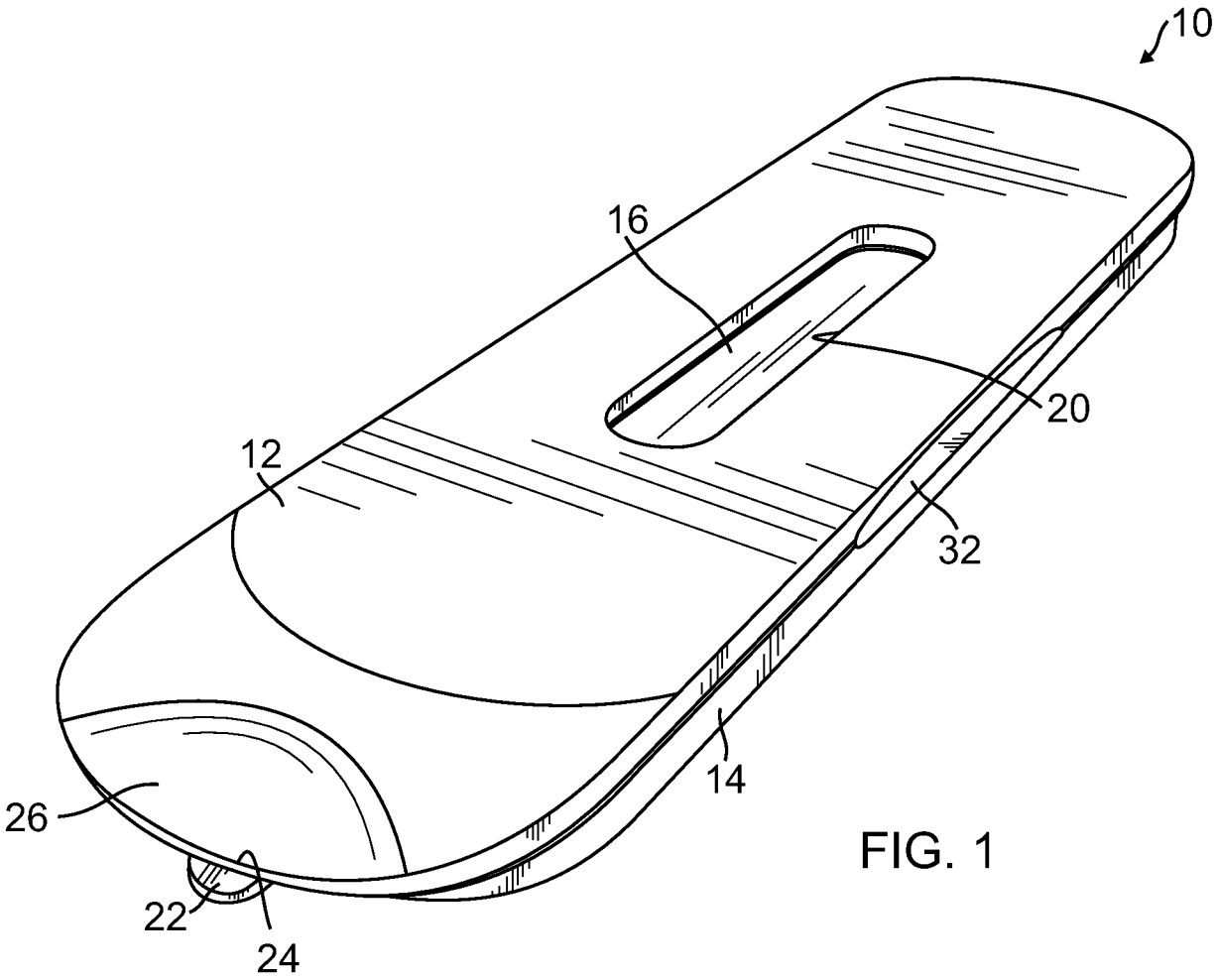
FIG. 1 a top perspective view of a nail file case, including a nail file, having features of the present invention, shown in a closed condition.
Figure 2:
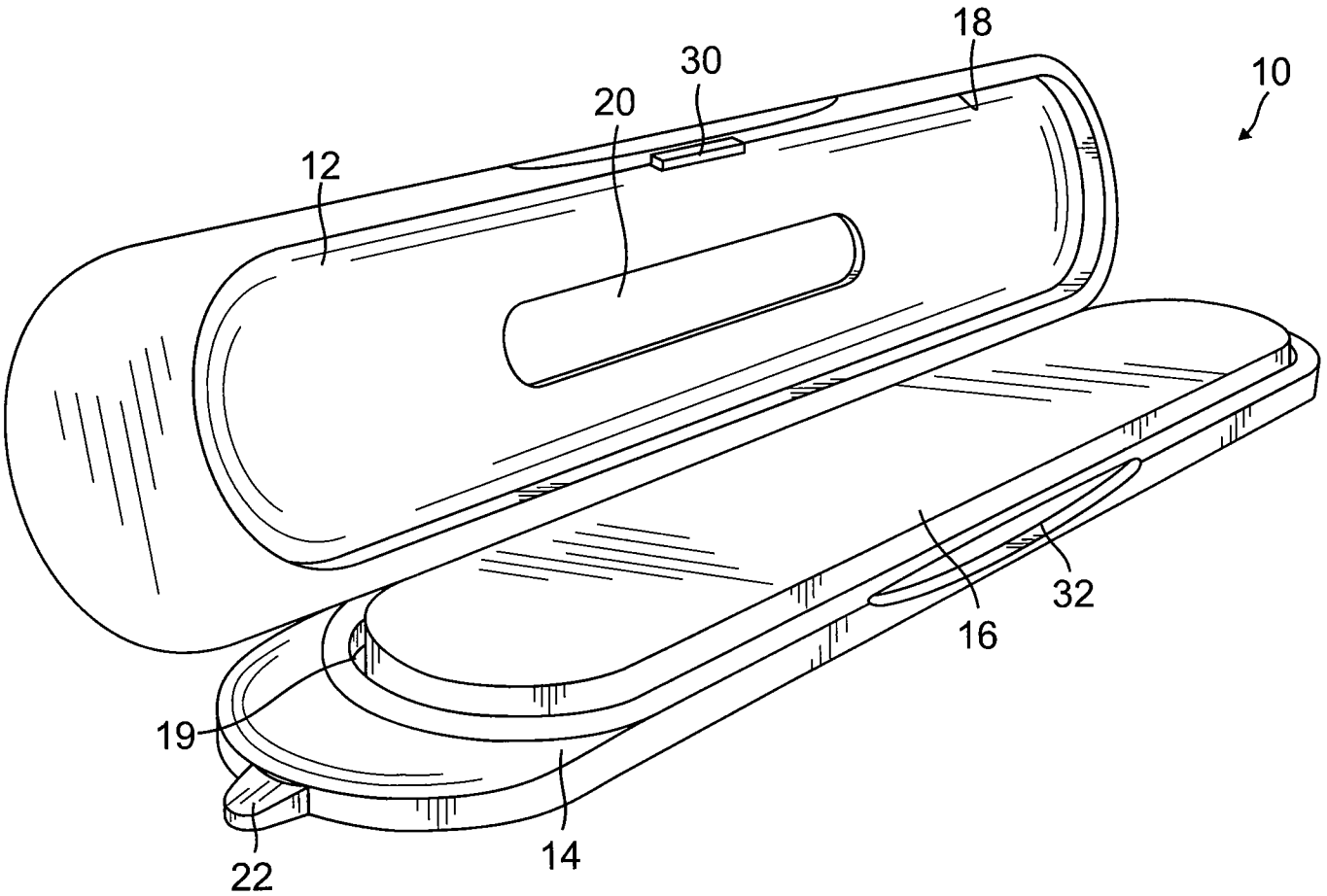
FIG. 2 is a top perspective view of the nail file case, including a nail file, of FIG. 1, shown in an open condition.

As shown in the drawings for purposes of illustration, the invention is embodied in a nail file case 10 preferably of the type having a clam shell construction with an upper lid 12 and a lower base 14 connected to each other by a flexible hinge 28 (FIG. 5) extending at least part way along adjacent edges of the lid and the base, respectively. When the case is closed (as seen in FIG. 1) the lid and base are held together in a closed position by a snap closure 30 (FIG. 2). When closed, the case can be opened with the aid of a finger grip 32 formed in the side of the case. Typical dimensions for such a case are 5 inches to 7 inches in length, 0.8 inches to 1.2 inches in width (when closed), and 0.25 inches to 0.35 inches thick (when closed).

A standard plastic or foam core nail file 16 may be positioned inside the case 10, as seen in FIG. 2. To facilitate containment of the file, an upper recess 18 may be provided in the lid 12, and a lower recess 19 may be provided in the base 14. Thus, when the lid is closed onto the base as in FIG. 1, the file 16 resides within the case 10 positioned within the upper recess and the lower recess. In a preferred embodiment, the recesses are dimensionally configured in terms of length and width to hold the file in place without appreciable movement inside the case.

Figure 3:
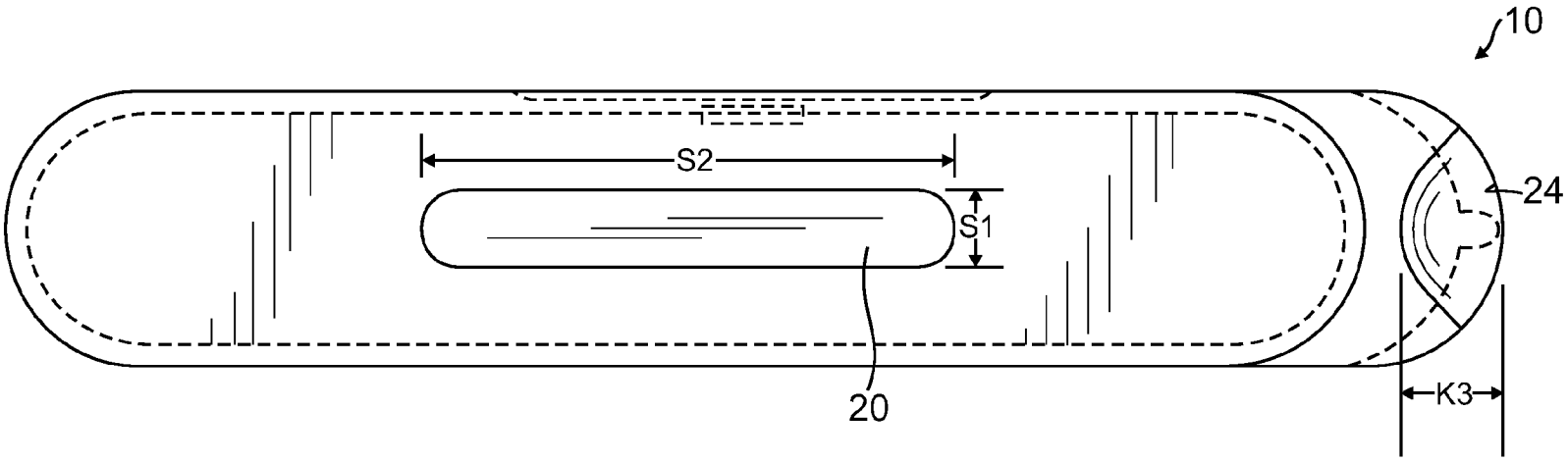
FIG. 3 is a top plan view of the nail file case of FIG. 1, shown in a closed condition.
Figure 4:
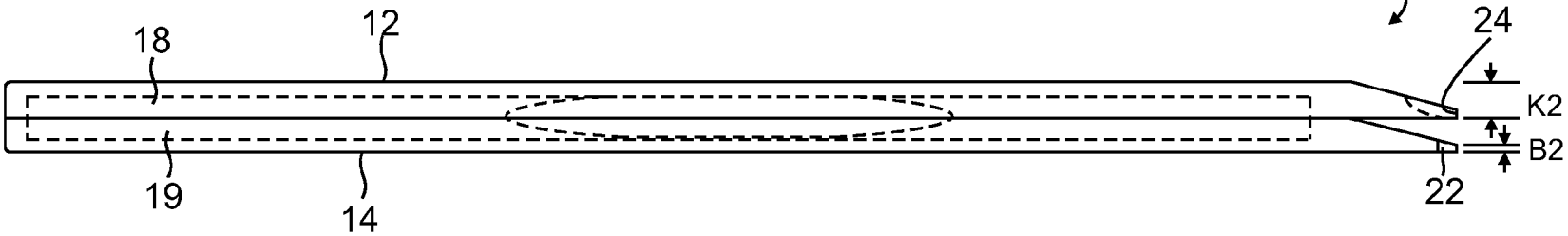
FIG. 4 is a side view of the nail file case shown in FIG. 3.

In accordance with the present invention, a slot 20 is included in the lid 12 to provide finger nail access to a file 16 inside the case when the case is closed. The slot can have different configurations and orientations but in a preferred embodiment, the slot extends longitudinally along the length of the lid terminating short of the ends. The slot extends completely through the lid, so that the abrasive surface on the file 16 is visible and accessible through the slot from the outside of the case. (FIG. 1) Preferably, the case is dimensionally configured in relation to the file so that the upper surface of the lid 12 in the vicinity of the slot, is separated from an upper surface of the file 16 by between 0.05 inch and 0.1 inch. The slot width S1 (FIG. 3) is preferably 0.2 inches to 0.4 inches. The slot length S2 is preferably 1.5 inches to 2.5 inches.

Figure 7:
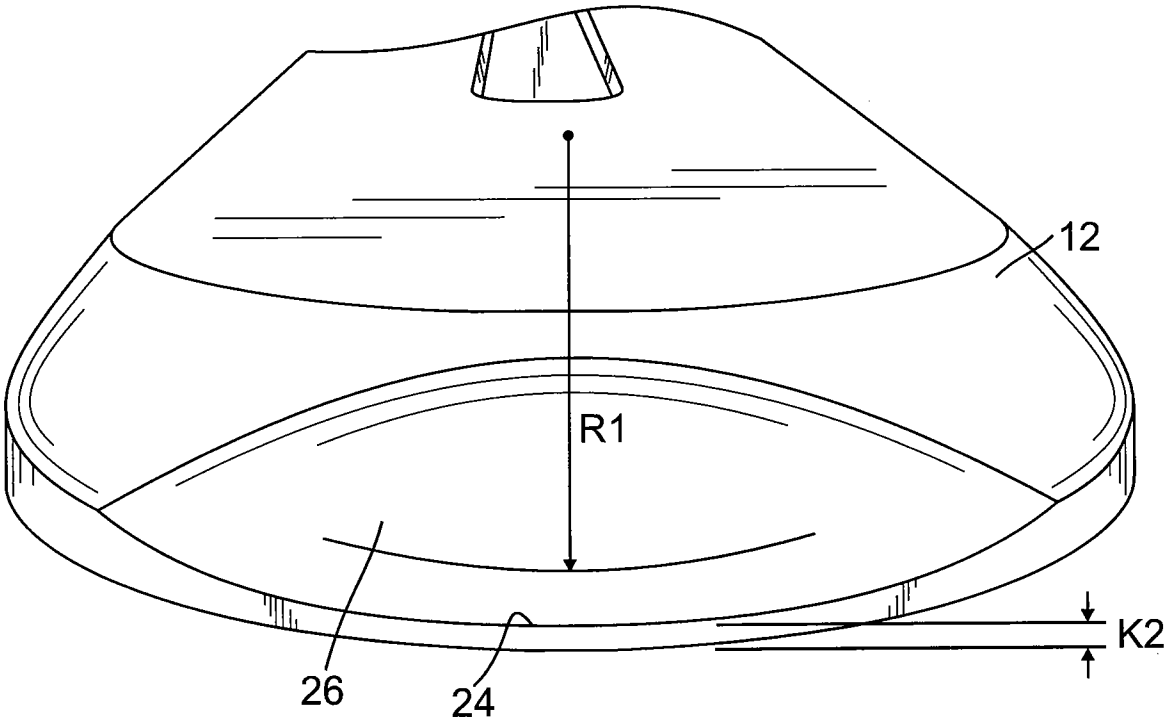
FIG. 7 is an enlarged, fragmentary, elevational view of an end portion of the lid of the nail file case of FIG. 1, showing the cuticle pusher in greater detail.

In some embodiments, a cuticle pusher in the form of blade 24 is formed into the upper lid 12 at a terminal end of the case. The blade is shaped for pushing the cuticle of a finger nail backwards. Preferably, the blade 24 is formed with a concave depression 26 on an exterior surface of the lid 12 which creates a thin leading edge along the terminal end of the lid adapted to act as a blade for pushing or scraping a cuticle. Preferably, the depression has a width K1 (FIG. 5) between 0.3 inches and 0.5 inches, a length K3 between 0.3 inches to 0.6 inches, and a radius of curvature R1 (FIG. 7) between 2.77" and 4.00"[R]. The blade 24 has a curved shape for accommodating curves in the shape of the cuticle at the base of a nail, and a crisp edge with sufficient bite for pushing or scraping a cuticle. Preferably, the blade 24 has an edge thickness K2 (FIG. 7) of between 0.02 inches and 0.06 inches.

Figure 8:
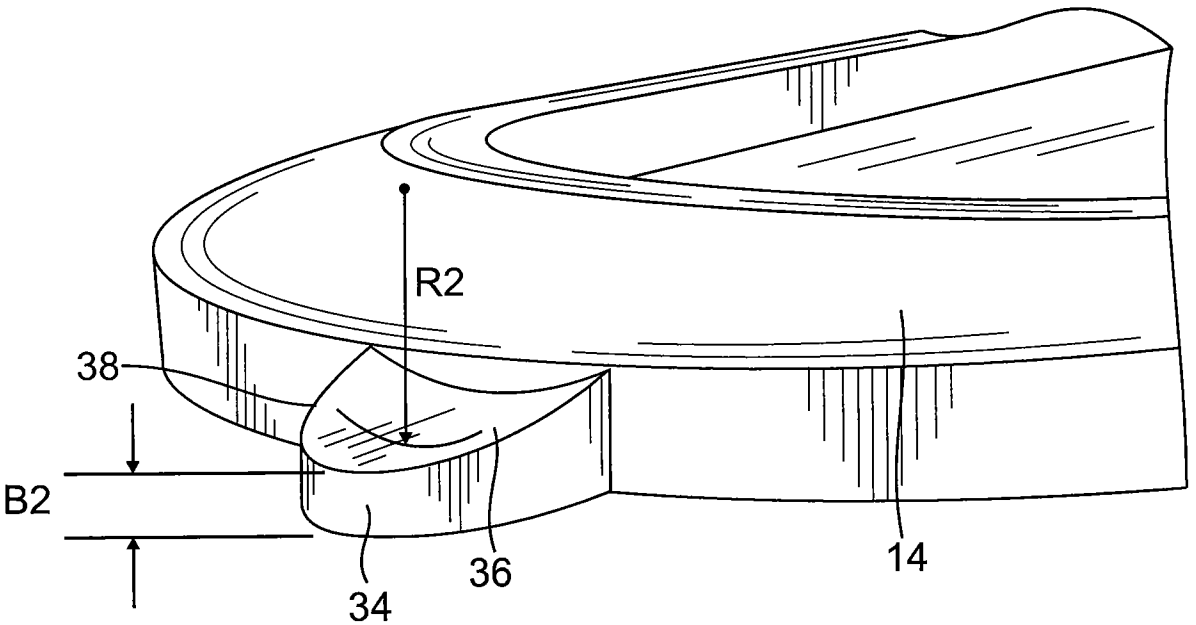
FIG. 8 is an enlarged, fragmentary, perspective view of an end portion of the base of the nail file case of FIG. 1, showing the nail cleaner in greater detail.

In further embodiments, a finger nail cleaner is provided in the form of a horizontal projection 22 on the lower base 14, also at a terminal end of the case. The projection is configured for inserting under the nail, and scraping out dirt that may have lodged there. In a preferred configuration, the projection extends longitudinally from the terminal end of the base, tapering in thickness and width from the base to a rounded tip 34. A longitudinal depression or concavity 36 is formed on an upper surface of the projection, the sides and end of which curve upward from the central maximum depth to form an upwardly facing edge 38 around the perimeter of the projection for scraping under the nail. Preferably, the projection has a maximum width B1 (FIG. 5) of between 0.3 inch and 0.6 inch, a thickness B2 (FIG. 8) at the tip of between 0.05 inches 0.2 inches, and the projection extends away from the lower base by an amount B3 which may be between 0.1 inches and 0.3 inches in length. The concavity preferably has a radius of curvature R2 (FIG. 8) of between 0.018" and 0.022". The projection is preferably positioned below the blade 24 and dimensioned to be smaller than the blade 10 so that the projection does not extend beyond the outer perimeter of the blade when the case is closed. If desired, the position of the nail cleaner and cuticle pusher can be reversed, so that the nail cleaner is formed on the lid while the cuticle pusher is formed on the base. Alternatively, both the nail cleaner and cuticle pusher can be formed on the same lid or base, but on opposite ends thereof.

Figure 5:
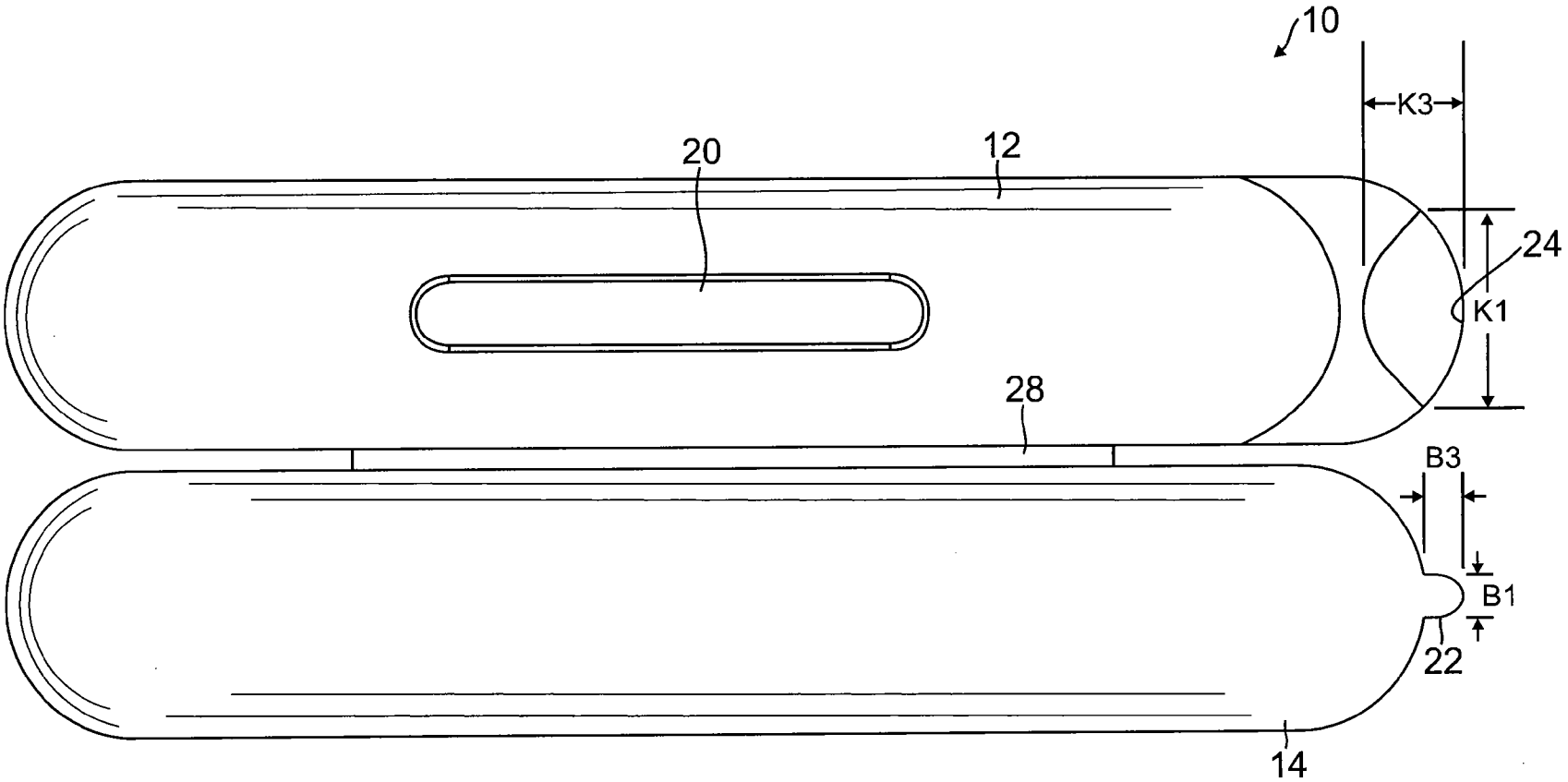
FIG. 5 is a rear plan view of the nail file case of FIG. 1, shown in a fully open condition.
Figure 6:
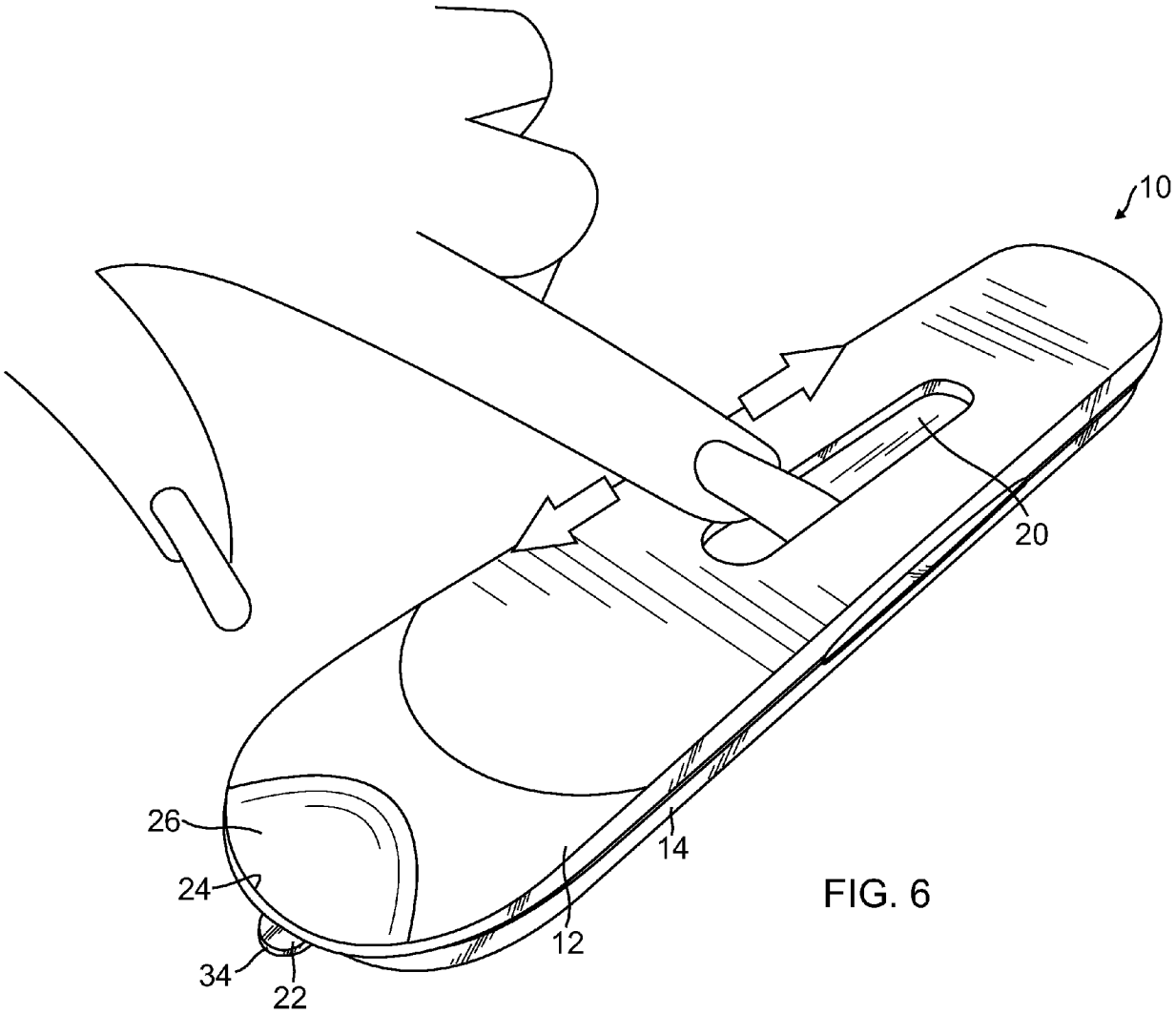
FIG. 6 is a schematic view of the nail file case of FIG. 1, being used to file a nail.

Armed with the nail file case 10 and a nail file 16 contained therein, the user may accomplish the following manicure actions:

First, the user may file a nail while the case is closed by inserting a tip of the nail through the slot 20, as seen in FIG. 5, and rapidly moving the nail up and down along the length of the slot. This action will abrade the nail and smooth or touch-up rough nail edges. The surface of the lid 12 prevents the user's skin from coming into contact with the abrasive surface of the nail file 16 during the filing action. The separation between the finger and the nail file surface also provides an additional safeguard feature, in which the nail cannot be filed shorter than the depth of the upper lid 12.

Second, the user may use the blade 24 to push back the cuticle of a finger nail in a manicure procedure. In order to accomplish this action, the user may turn the case upside down with the lid closed, and advance what would then be a lower surface of the case towards the cuticle, pushing it back, using the depression 26 as a surface to slide over the nail plate and help to prevent the blade from slipping off the nail when in use. Alternatively, the user may turn the case right side up with the lid open, and advance the blade towards the cuticle using the depression 26 as a registration point adapted to receive a pad of the forefinger of the operator's working hand when the tool is gripped for use. In this way, the forefinger can be used to impart control and thrust to the blade.

Third, the user may use the projection 22 to scrape out dirt from under the finger nail and collect the removed material in the void or shallow bowl created by the concavity 36. In order to accomplish this action, the user will typically open the case, as seen in FIG. 2, so that the full extent of the projection may be inserted under the nail.

From the foregoing, it will be appreciated that the nail file case of the present invention solves problems present in the prior art in an efficient and inexpensive manner. The nail file case may be molded in a single piece from plastic or other polymer compounds. The integrated nail care features described herein may be molded into the case without a large additional expense using plastic material capable of holding a sharp edge. These additional features bring the plastic or foam core nail file back up to the level of the old stainless steel nail files in terms of convenience features, while adding further useful features that were not present in steel files, such as providing a protective carrying case for the nail file.

The present invention may, of course, be carried out in other specific ways than those illustrated and described above without departing from the spirit and scope of the invention. The present embodiments are, therefore, to be considered in all respects as illustrated and not restrictive, while the scope of the invention is set forth in the claims that follow.

I claim:

1. A nail file case having two opposed ends and comprising:

a base;

a lid hingably and closably attached to the base between the two opposed ends such that, when the lid is closed on the base, the base and the lid define a region inside the case and a region outside the case, the region inside the case carrying an abrasive member, the lid further comprising an inner surface that faces the region inside the case, and an opposing outer surface, a slot in the lid, the slot comprising a hole that extends from the inner surface of the lid to the outer surface of the lid, the slot thereby exposing the region inside the case to the region outside the case such that the abrasive member is exposed to the region outside the case when the abrasive member is present in the region inside the case, a blade joined to the lid or the base and joined to one of said two opposed ends and said blade being formed by a concave depression, and a projection joined to the base or the lid and joined to said one of said two opposed ends and said projection having a concavity on its top surface and being adapted to scrape a fingernail and wherein the blade and the projection are in stacked relation to one another on said one of said two opposed ends of the case.

2. The case of claim 1, wherein the base and lid are attached with a flexible hinge.

3. The case of claim 1, wherein the abrasive member is a fingernail file.

4. The case of claim 1, wherein the abrasive member is a buffer.

5. The case of claim 1, wherein the base further comprises a recess adapted to receive the abrasive member.

6. The case of claim 1, wherein the lid further comprises a recess adapted to receive the abrasive member.

7. The case of claim 1, wherein the concave depression of the blade has a radius of curvature between 2.77-4 inches.

8. The case of claim 1, wherein the concavity of the projection has a radius of curvature between 0.018-0.022 inches.

9. The case of claim 1, wherein the slot is dimensioned to have a width of between 0.2-0.4 inches, a length between 1.5-2.5 inches, and a depth of 0.05-0.1 inches.

10. The case of claim 1, wherein the blade is dimensioned to have a length of 0.3-0.5 inches and an edge thickness of 0.02-0.06 inches.

11. The case of claim 1, wherein the projection is dimensioned to have a length of 0.1-0.3 inches and a width of 0.3-0.6 inches.

12. The case of claim 1, wherein the slot extends along a centerline of the lid.

* * * * *